United States Patent [19]

Sok Kyu

[11] Patent Number: 4,846,204

[45] Date of Patent: Jul. 11, 1989

[54] COLLAPSIBLE FRAME STRUCTURE FOR PORTABLE CAMP ROOM

[75] Inventor: Bae Sok Kyu, Seoul, Rep. of Korea

[73] Assignee: Moo Woong Choi, Seoul, Rep. of Korea

[21] Appl. No.: 32,219

[22] Filed: Mar. 31, 1987

[30] Foreign Application Priority Data

Apr. 1, 1986 [KR] Rep. of Korea ..... 1986-4080
Jun. 12, 1986 [KR] Rep. of Korea ..... 1986-8265
Jun. 12, 1986 [KR] Rep. of Korea ..... 1986-8266

[51] Int. Cl.[4] ..... A45F 1/16

[52] U.S. Cl. ..... 135/106; 135/110; 52/109; 5/414

[58] Field of Search ..... 135/106, 109, 110; 5/414; 248/436, 277; 403/85; 52/109

[56] References Cited

U.S. PATENT DOCUMENTS

| | | | |
|---|---|---|---|
| Re. 31,565 | 4/1984 | Beaulieu | 52/109 |
| 925,922 | 6/1909 | Knapke et al. | 52/109 |
| 2,055,044 | 9/1936 | Nelson | 5/414 |
| 3,435,570 | 4/1969 | Berry | 52/109 |
| 3,601,325 | 8/1971 | Moorhead | 5/414 |
| 3,757,360 | 9/1973 | Wescott | 135/109 |
| 3,888,056 | 6/1975 | Kelly et al. | 52/109 |

FOREIGN PATENT DOCUMENTS

| | | | |
|---|---|---|---|
| 9593 | 8/1906 | Denmark | 135/110 |

*Primary Examiner*—Henry E. Raduazo
*Assistant Examiner*—Caroline D. Dennison
*Attorney, Agent, or Firm*—David H. Semmes

[57] ABSTRACT

A collapsible frame structure for a portable camper, particularly a pair of such frame structures which may be joined to form a bed supporting frame and a tent supporting frame extending in an arch over the bed frame. The frame structure includes a plurality of pairs of link tube units pivotably connected at their middles to each other in X-shaped configuration and a plurality of longitudinally extending tube units intermediate the pairs of link tubes. The frame structure is distinguished in its efficiency in set up and folding for storage without disassembly.

3 Claims, 8 Drawing Sheets

COLLAPSIBLE FRAME STRUCTURE FOR PORTABLE CAMP ROOM

BACKGROUND OF THE INVENTION

The present invention relates to a supporting frame structure for a camp room, and more particularly a portable frame structure of the folding and expanding type to support a tent or bed without disassembly or removal of parts.

In the past, a number of different collapsible frames have been provided for tent or bed support, however, none of these frames includes an X-shaped collapsible-link bed supporting frame, cooperatively linked to an X-shaped collapsible-link tent-supporting frame. The present invention is designed to solve the inconvenience of folding, handling, installing, keeping together and carrying of conventional portable frames.

SUMMARY OF THE INVENTION

The present collapsible frame structure for a portable camp room includes a plurality of pairs of free-ended link tubes connected to each other intermediately of their feee ends as X-shapes, said pairs of link tubes being pivotally connected at their free ends to a link slider. The link slider units include a first hole therein to slidably accommodate a longitudinally exetnding rib tube unit and a second hole defined in a projecting portion of the link slider to accommodate a tension rope and tension stopper or stretching strap. A plurality of tent supporting rib units may be secured on the free ends of the rib tube units, the same including a cap with a projecting conical member for engaging a tent fabric.

A second plurality of *vertically* extending tube units, each including a main tube and a sub-tube slidably inserted within the main tube, may be provided together with a second plurality of link tube units, and link tube supporters so as to fold freely as a bed supporting frame. A fixed fabric supported may be defined to engage the upper tube ends in the bed frames respectively consisting of a bore, a core element supported therein, and an elastic ring which has an inclined or wedge-shaped hole to hang the core element, so as to accommodate the tightening force of a bolt which presses the inner wall in of the vertical tube.

One important feature of the present invention is that this combination of collapsible frame structures combines both tent and bed supporting structures which are installed, conveyed, removed, or kept in place without disassembly into small units, and the two frame structures can be folded, unfolded, set-up or removed independently from each other.

DETAILED DESCRIPTION

Figure 1:
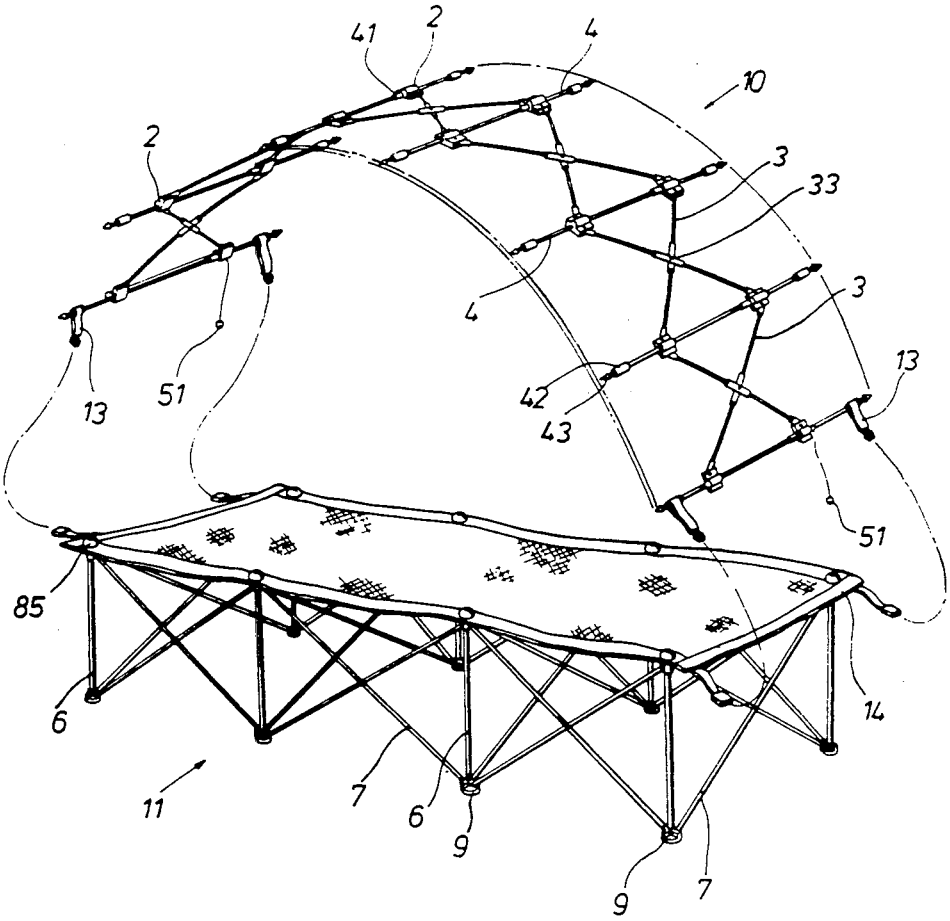
FIG. 1 is an exploded, perspective of the present collapsible frame structure for a portable camp room, extended as an arc over a second collapsible frame structure bed support.

As shown in the drawings, the present collapsible frame structure for a camp room is roughly divided into two structures, i.e., a tent-supporting structure and a bed-supporting structure, which are connected to each other. In other words, the present collapsible frame structure constitutes a plurality of longitudinally extending main tubes and sub-tubes slidably connnected to each other and fixed at their respective ends to a fixed tent supported and a bed supporter.

A plurality of the fixed supporters are illustrated. Each fixed supported consists of a bolt extending into the fixed supporter, a capsule-shaped core element placed under the said bolt, an elastic ring which has an inclined hole with a wider inlet than outlet to engage safely a core element thereon. A fixed supported body supports the ends of the main tubes thereof. A cap or cover is provided for and a tent fabric clip is supported on each bolt. A plurality of suitable straps 13 may interconnect the tentsupporting structure and the bed-supporting structures.

Figure 2:
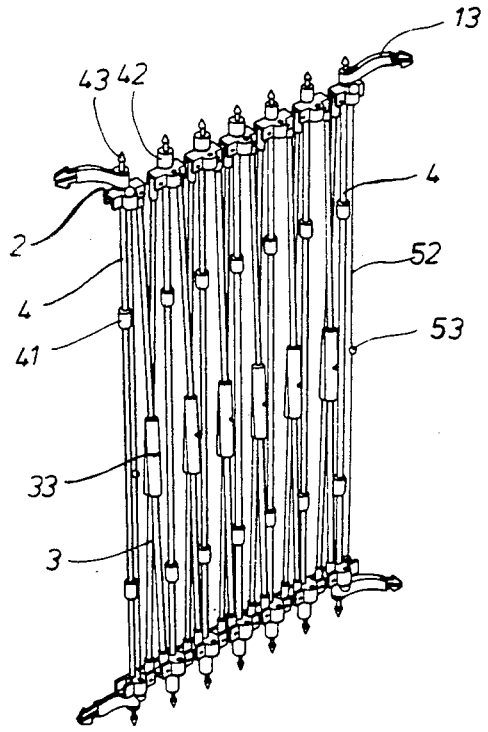
FIG. 2 is a perspective of the collapsed, folded tent supporting frame.
Figure 3:
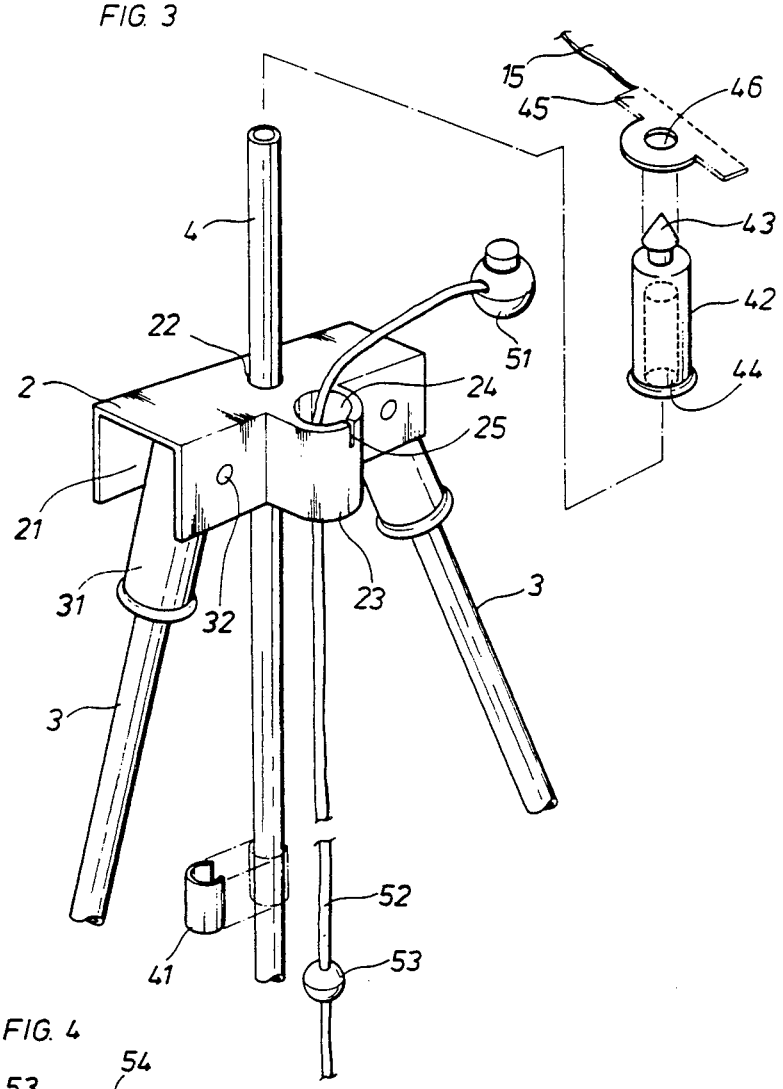
FIG. 3 is an exploded fragmentary perspective of the link slider with a tension rope.
Figure 4:
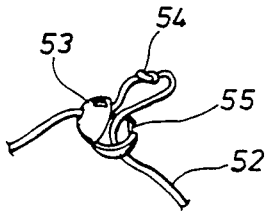
FIG. 4 is a fragmentary perspective of the tension stopper which shows two hemispherical parts and a knot in the tension rope to fix the stopper thereon.

In FIG. 3, link slider (2) includes a channel-shaped profile with hollow space (21) and opposed walls upon which link tube supporter (31) is pivotally joined by a pin or rivet (32), and a vertical hole (24) through which tension rope (52) and tension stopper (53) are passed. A portion of rope (52) and tensioning knot (51) extends above hole (24) and front projecting member (23). A slot (25) is defined in the upper front side of projecting member (23) as a stop for rope (52). A hole (22) is defined in the top of link slider (2) in which the longitudinally supporting rib (4) is slidably inserted, so that link slider (2) is slidably movable upward or downwardly thereon. Link tube ends (3) are inserted within link tube supporter (31) which is joined to the wall of the link slider (2) by pins or rivets (32). Associated pairs of link tubes (3) are crossed, as illustrated in FIG. 2 and joined at their mid-portion by pin or rivet (33) in X-shaped configuration which may be compressed vertically or folded laterally as illustrated in FIG. 2. As illustrated in FIGS. 3 and 4, the tension device includes tension rope (52), tension stopper (53) in which rope knot (54) is positioned within two hollow hemispherical parts for fixing the stopper (53) upon the rope (52), in the full tensed state.

Figure 5:
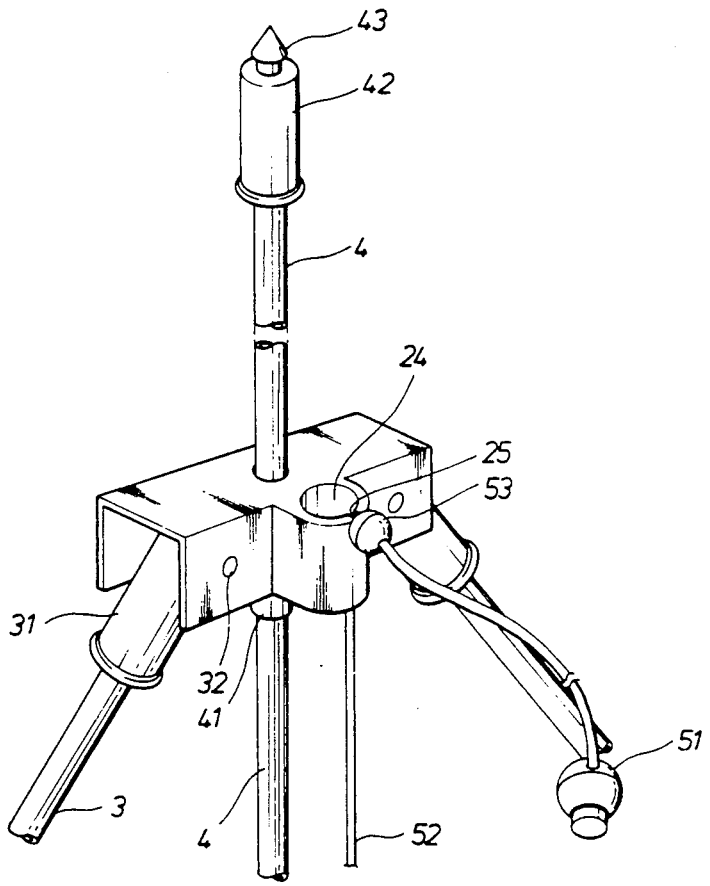
FIG. 5 is a fragmentary perspective of full tensed state in supporting a tent by bending the tent supporting frame in an arc, as illustrated in FIG. 1.

As illustrated in FIGS. 2 and 3, the tent supporting unit consists of tube (4) upon which link slider (2) is slidably moved upwardly or downwardly by means of hole (22). Tube clip (41) fits tube (4) as a stop for link slider (2) so that the stroke of the sliding link slider (2) is limited when bending the tent supporting frame in an arc as illustrated in FIG. 1. A cap member (42) grooved with a center slot (44) pointed with projecting conical member (43) is supported at each end of tube (4) as illustrated in FIGS. 3 and 5. In center slot or groove (44), the end of tube (4) is tightly inserted as illustrated in FIGS. 1, 3 and 5. The upper part of cap (42), conical member (43) has a neck matched to ring hole (46) of rock ring member (45), which is secured to tent fabric (15) as shown in FIG. 3.

When the above tent supporting structure is stretched out or unfolded as illustrated in FIG. 1 by bending thereof, both conical members (43) are fitted and linked with the ring member (45) of tent (15). The link slider (2) is downwardly and slidably moved on supporting rib (4) and stopped at rib clip (41) which is in predetermined position for full tension, as tension rope (52) is stretched through hole (24) of the projecting member (23) of the link slider (2), and tension stopper (53) is suspended within slot (25) by means of tension rope (52) as in FIG. 5, which illustrates the full expanded position of the frame. See also FIG. 2 wherein the rope 52 is shown to extend from one slider to another. When closing the tent supporting structure, the tension stopper (53) is removed from the slot (25), then passed through hole (24) and to the lower frame-relaxed positioned illustrated in FIG. 3.

Figure 6:
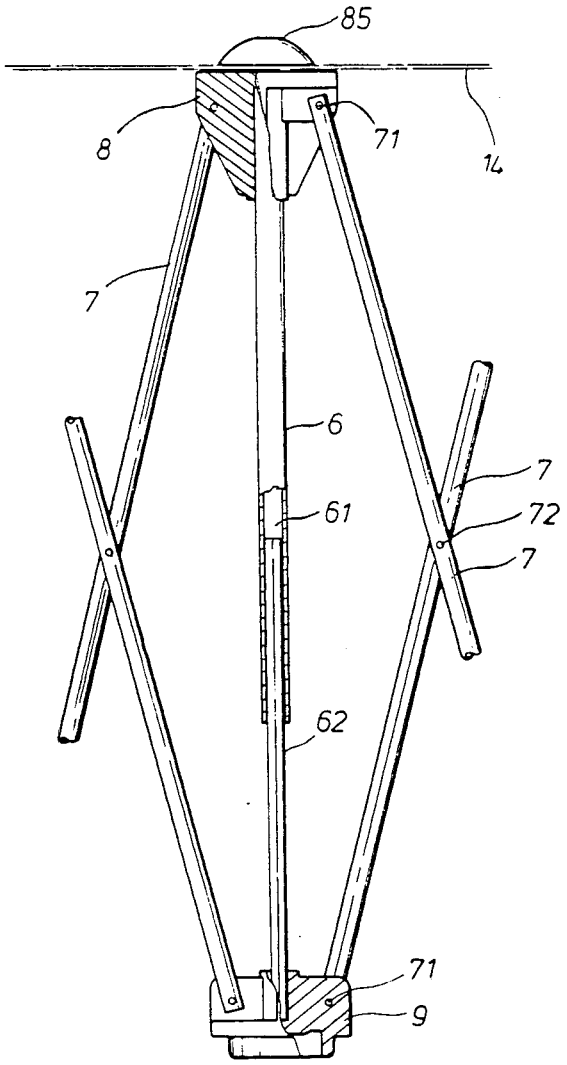
FIG. 6 is a fragmentary vertical section showing the pair of link tube units in X-shaped configuration and expanded as a bed supporting frame.
Figure 7:
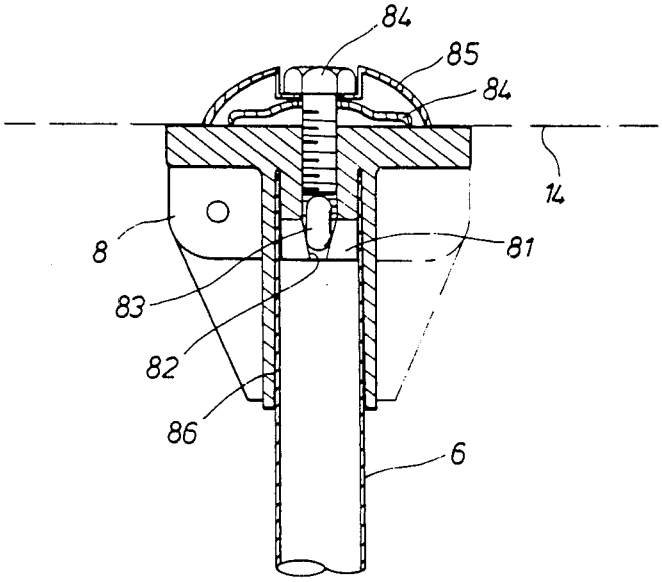
FIG. 7 is a fragmentary vertical section of the upper part of the fixed stoper attached to the longitudinally extending tube ends of FIG. 6.

As illustrated in FIGS. 6 and 7, a unit of the bed-supporting frame consists of upper main tube (6) which is inserted and fixed between elastic ring (81) and the inner wall of fixing stopper (86). The lower sub-tube (62) is slidably inserted within main tube (6) and fixed at its free end in the lower fixed supporter (9). A pair of link rods or link tubes (7) are pivoted to the upper supporter (8) and lower supporter (9) and joined at mid-section in an X-shaped configuration by pin or rivet (72) to each other, as shown in FIGS. 1 and 6.

Figure 8:
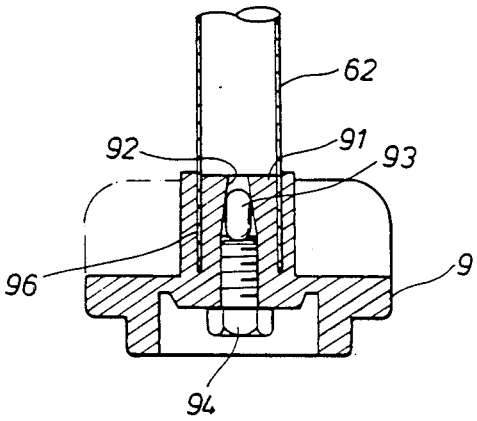
FIG. 8 is a fragmentary vertical section of the lower part of the fixing stopper.
Figure 9:
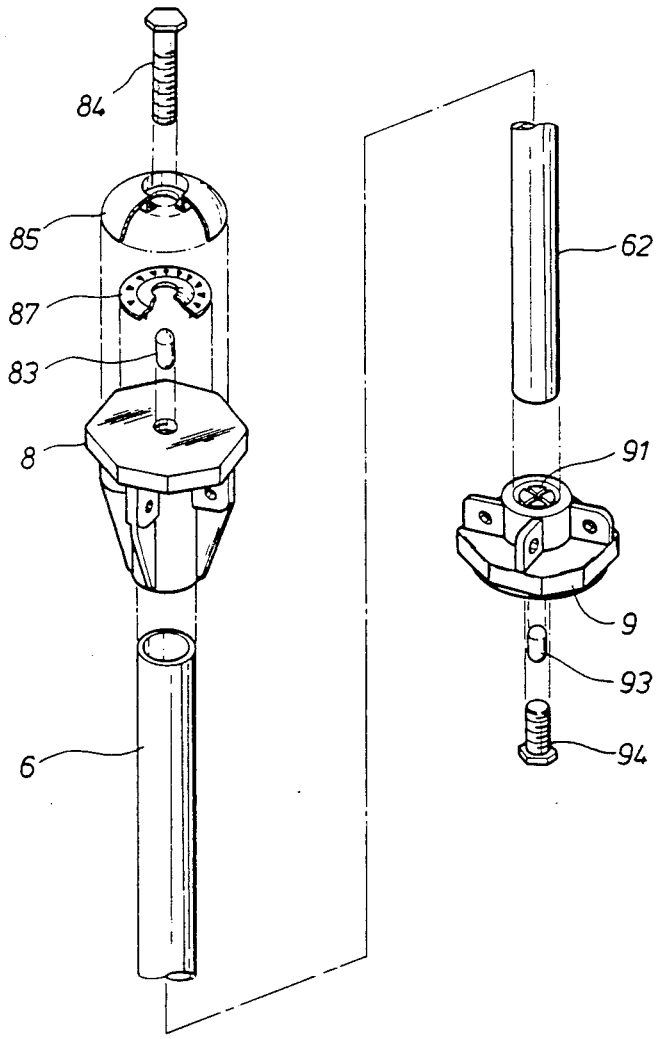
FIG. 9 is a fragmentary and exploded perspective of the fixed stopper of FIGS. 7 and 8 showing the various parts.
Figure 10:
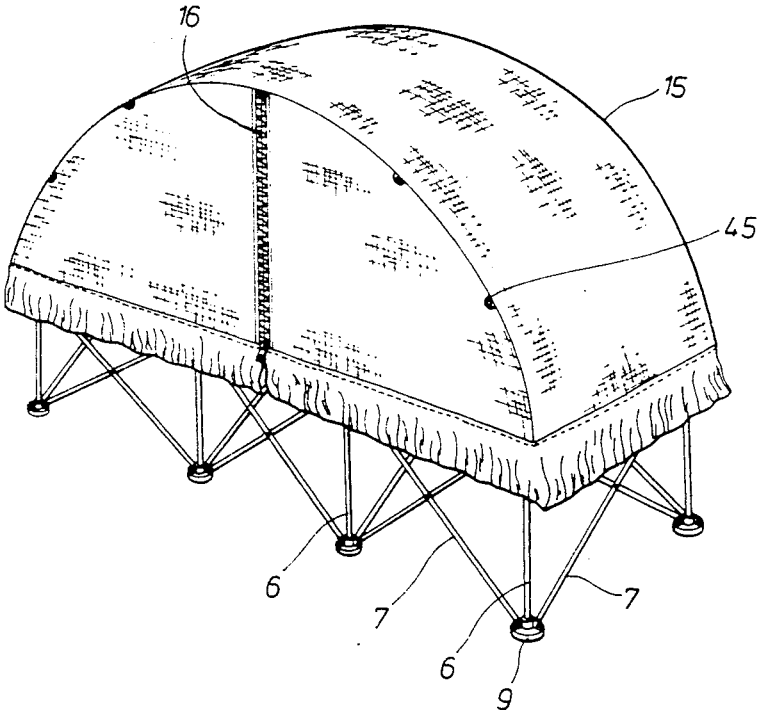
FIG. 10 is a perspective of a camp room set-up according to the present invention.

A vertical section of the fixing supporters (8), (9) is shown in FIG. 7 and FIG. 8. Main vertical tube (6) is supported by the inner wall (86) of the fixed supporter (8) at its exterior and at its interior by the wall of elastic ring member (81) which may be formed from tough plastic material. Elastic ring (81) has an inclined hole (82) having an inlet which is broader than the outlet so as to support the capsule-shaped core element (83) aligned with the bolt (84) tip, so as to apply pressure to the ring (81) when threading or screwing bolt (84) within fixed supporter (8). A fiber sheet (14) may be secured to fixed supporter (8) by means of fiber fixing hook (87) supported upon the bolt (84) shank. A cap (85) covers fixed supporter (8). When bolt (84) is tightened by threading, then the tightening pressure is applied to core element (83) and thus the elastic ring (81), finally pressurizing the outer wall of the tube (6) against fixed supporter wall (86) as in FIG. 7. This mode pertains to the lower fixed supporter (9), that is, the same mechanism is applied in setting bolt (94), core element (93), elastic ring (91), tube (62) within the lower fixed supporter (9).

An important advantage of the present invention is that this collapsible frame structure can be set-up, folded and unfolded, assembled or disassembled, and carried, handled or stored without disassembling or dividing parts thereof. Another advantage is that a combination of two supporting structures, one for supporting a bed and another for supporting a tent, are simultaneously provided.

By means of this mechanism, a bed is rigidly supported by a frame comprised of pairs of X-shaped link tubes connected pivotally to fixed supporter and pairs of main tubes and sub-tubes slidably engaging each other. The rigidity of the frame on the ground eliminates vibration, thus preventing damage due to wear or abrasion and enabling easy set up and handling, as well as folding for storage without disassembly.

I claim:

1. A collapsible and portable camp room tent and bed therefor wherein the tent extends over the bed in an arc comprising:

(A) a tent supporting frame and tent fabric therefor including:

(A1) a first plurality of connected link tube pairs each plural link tube thereof having free ends, said link tubes being connected to each other immediately of their free ends in X-shaped configurations;

(A2) a plurality of opposed link tube supporter-sliders in which the free ends of adjacent link tubes are pivoted, said sliders each defining adjacent apertures which pass therethrough;

(A3) a plurality of tent supporting ribs, each said rib slidably extending through one aperture of respective supporter-sliders, between the pivoted link tubes;

(A4) a link tube tension rope, extensible through the other aperture of opposed link tube supporter-sliders, whereby to tension said respective pairs of link tubes;

(A5) at least one clip mounted upon each of said supporting ribs intermediate ends thereof as a limit to the stroke of the supporter slider;

(A6) a tent fabric holding cap affixed to respective ends of said supporting ribs;

(B) a bed supporting frame, interconnected at ends thereof to the tent supporting frame including:

(B1) a second plurality of connected link tube pairs which are equivalent in X-shaped configuration to the first plurality thereof; and (B2) a vertically extending main tube and sub-tube, the latter being slidable within the former;

(B3) upper and lower interconnecting supporters for ends of the respective main tube and sub tube, said supporters also providing pivots for the link tubes of the tube pairs forming the bed frame;

(B4) a cap assembly covering the upper bed supporter; and (B5) a bed fabric secured by the cap assembly to upper supporters of the bed supporting frame.

2. A collapsible and portable camp room tent and bed according to claim 1, said tent supporting frame further including a tensioning bolt and log for securing the tent fabric thereto.

3. A collapsible frame structure for a portable camp room tent and bed as in claim 1, said link slider forming a front projecting member which defines one aperture and a slot for sliding and securing the tension rope therein.

* * * * *